United States Patent [19]

Kawai

[11] 3,995,953

[45] Dec. 7, 1976

[54] ELECTROPHOTOGRAPHIC APPARATUS

[75] Inventor: Yoshihisa Kawai, Aichi, Japan

[73] Assignee: Minolta Camera Kabushiki Kaisha, Osaka, Japan

[22] Filed: Oct. 29, 1974

[21] Appl. No.: 518,941

[30] Foreign Application Priority Data

Oct. 30, 1973 Japan ..... 48-122520
June 26, 1974 Japan ..... 49-73561

[52] U.S. Cl. ..... 355/14; 271/259; 340/259; 355/16; 355/55

[51] Int. Cl.[2] ..... G03G 15/26

[58] Field of Search ..... 355/14, 16, 55, 56, 355/3; 340/259; 271/258, 259

[56] References Cited

UNITED STATES PATENTS

| | | | |
|---|---|---|---|
| 3,450,995 | 6/1969 | Hirsch | 355/14 UX |
| 3,698,805 | 10/1971 | Hickey et al. | 355/14 |
| 3,737,159 | 6/1973 | Washio et al. | 340/259 X |
| 3,791,732 | 2/1974 | Mihalik et al. | 355/14 |
| 3,878,540 | 4/1975 | Kawai | 340/259 |
| 3,909,128 | 9/1975 | Sohm | 355/14 X |

*Primary Examiner*—L. T. Hix
*Assistant Examiner*—Kenneth C. Hutchison
*Attorney, Agent, or Firm*—Wenderoth, Lind & Ponack

[57] ABSTRACT

An electrophotographic apparatus having an endless electrophotosensitive belt transportable past a plurality of work stations and including paper supply and transport means and a unitary control circuit which actuates work stations and other apparatus elements in a required succession and at frequencies which vary in accordance with copy magnification required. The control circuit itself is actuated in response to signals supplied by one of several rotatory switching means which are rotated synchronously with the electrophotosensitive belt, thereby ensuring matching of belt and apparatus element action.

The apparatus may further comprise detection switches which are disposed at various points along the path of travel of copy paper through the apparatus, and are actuable by passage of a sheet of copy paper, and the successive actuation of which is a necessary condition for continued actuation of the control circuit and sequential operation of work stations. Upon the occurrence of a paper jam and consequent failure of a sheet of copy paper to reach and actuate a detection switch, apparatus operation is stopped and a lamp or similar warning means indicative of the location of the paper jam is activated.

5 Claims, 6 Drawing Figures

| point reached | cam | flip-flop on | TC | SFM | BM | CH | ELI | CL4 | FT |
|---|---|---|---|---|---|---|---|---|---|
| Switch 33/34 | | f1 | | | | 1 | 1 | 1 | |
| a | 13 | f2, f8 | | | | 1 | | 1 | |
| b | 14 | f3, f8 | | 1 | 1 | 1 | | 1 | |
| Switch 59 ON | | | | 1 | 1 | 1 | | | |
| c | 15 | f3, f4 | | | 1 | | 1 | | |
| d | 16 | f5 | | | 1 | | 1 | | 1 |
| e | 17 | f6 | 1 | | 1 | | 1 | 1 | |
| Switch 59 off | | f7 | 1 | | | | 1 | 1 | |
| f | 18 | | | | | | | | |

ELECTROPHOTOGRAPHIC APPARATUS

The invention relates to the field of electrophotography. More specifically the invention relates to electrophotographic apparatus in which an electrophotosensitive member is constituted as, or is carried on a flexible endless belt, and which includes means for control of apparatus elements in synchronism with belt movement, and means for halting apparatus operation and causing indicator lamps, or similar warning means to be actuated upon the occurrence of a paper jam at any one of various points within the apparatus.

A commonly employed method of electrophotography comprises imposing a generally uniform charge on an electrophotosensitive medium, which includes a photoconductive layer on a conductive backing, exposure of the medium to image light reflected from a document, or other information medium, to be copied, thereby forming an electrostatic image of the document on the electrophotosensitive medium, coating the medium with charged toner particles, which arrange themselves thereon in a configuration corresponding to the electrostatic image of the document, and transfer of toner particles onto a sheet of copy paper, or other receiving surface. In a practical electrophotographic apparatus an electrophotosensitive medium is provided in the form of plates, or a drum, or a continuous belt, which may be cleaned of residual toner particles after each production of a copy, and re-used. From the stand-point of design considerations, an endless belt has advantages over plates or a drum since different portions of the belt path may be vertical, horizontal or inclined, as required, thus permitting greater freedom in the disposition of the other elements of the apparatus.

In an electrophotographic apparatus a photosensitive belt is carried past fixed work stations which effect the work operations referred to above in a requisite order, and there is also provided means to supply sheets of copy paper at requisite intervals to contact with an image carrying portion of the photosensitive belt, then to pass the copy paper through a fixing station, which contains, for example, a heater for effecting firm adhesion of toner particles in an image configuration on successive sheets of copy paper, and then to pass the copies out of the apparatus.

In such an electrophotographic apparatus it is, of course, necessary to provide control means to cause the requisite work operations to be effected in a timed sequence, which is carried out only once or repeatedly according to whether one or a plurality of copies of an original document is required. Also, ideally, in order to obtain copies at different magnifications, it should be possible to vary the duration of work operations. Conventionally, sequence control is effected by an electrical means comprising counters, timers, and work station control circuits which are actuated in response to input supplied thereto by detection means, including, for example, photocells provided at suitable locations along the endless path of the photosensitive belt or the path over which the copy paper travels, and responsive to belt or paper movement, or by timer circuits. A drawback of such a control system is that it involves mounting of a relatively large number of independent elements, which is disadvantageous both in initial assembly and in maintenance. If it is attempted to overcome this problem by the provision of one or at least comparatively few timer circuits for effecting complete control of the work stations, there is a strong possibility that after the apparatus has been in use for a certain time actuation of work stations and photosensitive belt movement will be out of step, thus resulting in incomplete or unsatisfactory copies.

A not infrequent maintenance problem associated with electrophotographic apparatus is that of jamming of copy paper transport thereof through the apparatus. This problem can be particularly serious if copy paper becomes jammed in a fixing station and is subjected to continuing application of heat, which may result in risk of fire. It is therefore highly desirable that control means include means for effecting apparatus shutdown and actuation of warning elements in the case of copy paper jam.

It is an object of this invention to provide an improved electrophotographic apparatus comprising control means which is actuated in direct response to movement of a photosensitive medium, and causes work operations to be performed in a timed sequence to produce one or more copies at a selected magnification.

It is a further object of the invention to provide means which are actuated in direct response to copy paper movement and halt apparatus operation and actuate warning means upon occurrence of a copy paper jam at any one of various stages of copy paper transport.

In accordance with a disclosed embodiment of the invention, the apparatus includes an electrophotosensitive belt able to form an electrostatic image in response to image light directed thereonto from a document, or other information medium to be copied and movable over an endless path past a series of work stations, and also includes means for supply of image-receiving media into transfer contact with the belt and subsequent transport thereof out of the apparatus, the main elements of the apparatus being constituted as independently removable units, to facilitate maintenance.

The apparatus also includes control means which effects actuation of the various work stations in a requisite sequence, makes it possible to obtain a single copy or a plurality of copies, and allows selection of different magnifications of copies. The control means comprises a unitary circuit the elements of which are sequentially caused to function to actuate the work stations by switches which are operated by cams rotated synchronously with the photosensitive belt, whereby control means operation and belt movement are always in step.

In a further embodiment of the invention operation of certain elements of the control circuit is dependent upon actuation of detection means by copy paper at certain points passed during copy operation. In the case of non-actuation of any one of these detection means, i.e., when copy paper jams at some point, apparatus operation is stopped, and a warning lamp, or similar means, is lit, different lamps being lit to indicate stoppage of copy paper at different points.

The invention will now be described in connection with the accompanying drawings, in which.

Figures 1, 3:
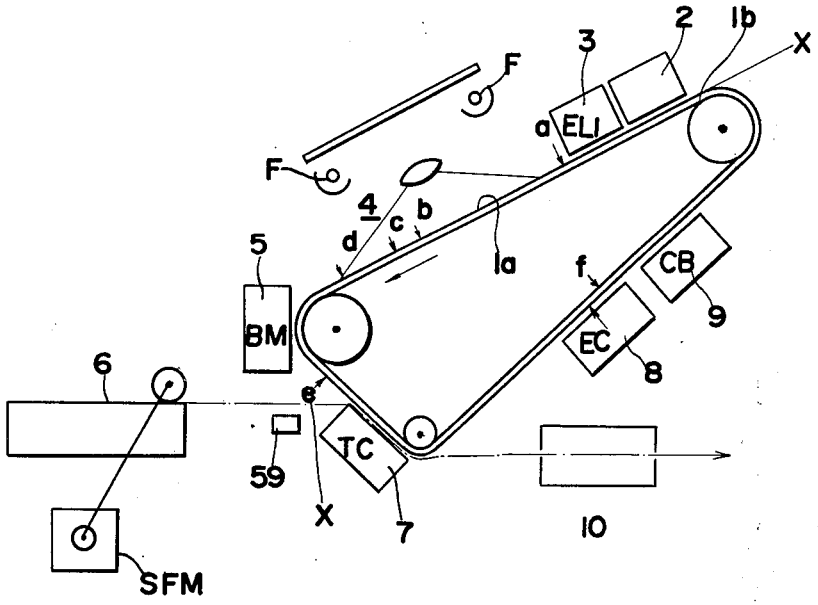
FIG. 1 is a schematic layout view of an electrophotographic apparatus according to a first embodiment of the invention showing reference points along the path of of photosensitive belt travel.
FIG. 3 is a timing chart for the operation of the apparatus of FIG. 1.

Reference is first had to FIG. 1, which is a block diagram to illustrate action of an electrophotographic apparatus according to the invention. A photosensitive belt 1 is roll-driven around a continuous path, and has a joint 1*b*, which will taken as a reference point in the description below. A normal photosensitive belt such as the belt 1 is several times longer than the copy of a document to be produced, and it is thus possible to obtain successive copies of a document, or documents, on successive portions 1*a* of the belt 1, separated by non-image-carrying, or inter-image portions 1*c*, the joint 1*b* being unsuitable for production of an image and therefore included in an inter-image portion 1*c*. The length of belt required to produce one image is thus the length of a copy, which may vary according to magnification required, supplemented by the inter-image space, or (1*a* + 1*c*). Supposing a belt of total length L can provide space for a total number *n* of images at a particular magnification, it is evident that $(1a + 1c) = L/n$, and it is also apparent that to obtain copies rapidly, and to avoid unnecessary actuation of the apparatus, it is preferable to move the belt only over the distance (1*a* + 1*c*) for each copy obtained. This is effected in the apparatus of FIG. 1 by a control means described later, the general action being as follows. Supposing the belt joint 1b to be initially at a starting point X adjacent to an uppermost roll, as indicated in the drawing, when the belt rolls are actuated, the joint 1*b* is brought to a point *a*, after being carried past a corona charger 2, which serves to impose a generally uniform charge on the belt 1, and a spacing eraser lamp 3, which serves to erase the charge on inter-image portions of the belt 1, i.e., belt portions not intended to carry an image. As the rolls continue to rotate, the belt joint 1*b* is brought to a point *b*, while at the same time the corona charger 2 (CH) is actuated to charge the belt 1. During this time a copy paper transport means, not indicated, which is controlled by means of an electromagnetic clutch CL4 carries a sheet of copy paper, which has been previously supplied thereto from a copy paper reserve 6, as far as the entry to a transfer station 7, having a transfer corona corona unit TC, at which location the copy paper causes a detection switch 59, which is described in greater detail below, to be operated. The copy paper transport means is actuated at intervals during the obtaining of one copy of a document D, and causes a sheet of copy paper to be moved successively to and through the transfer station 7 (TC), through a fixing station, then out of the apparatus. When point 1*b* is reached, a toner brush motor (BM) in a developing station 5 is started, in order to effect application of toner particles onto a subsequently exposed image-carrying portion 1*a* of the belt 1, and at the same time, a paper feed motor SFM is actuated to cause a sheet of copy paper to be supplied from the copy paper reserve 6 to the copy paper transport means, in readiness for the next following copy.

Next, the joint 1*b* is carried a little further to a point *c*, whereupon the copy paper supply motor SFM, the corona charger 2 (CH), and the copy paper transport means control clutch CL4 are de-energized, while the toner brush motor BM of the developing station 5 continues to function, and the spacing eraser lamp 3 (ECI) is turned on.

Upon arrival of the joint 1*b* at a further point *d*, the whole of that portion 1*a* of the belt 1 which has been charged by the corona charger 2 lies in an exposure area 4, and may be exposed to light reflected from a document D supported on a transparent rest in an upper part of the apparatus. Hereupon, a flash trigger circuit FT is actuated to cause flash lamps F to illuminate the document D and effect exposure of the belt portion 1*a* in the exposure area 4.

The belt 1 is still continuing to rotate, and so the joint 1*b* is carried past the developing station 5, whereat the exposed belt portion is coated with toner particles, and is brought to a point *e* intermediate the developing station 5 and the transfer station 7. Hereupon the electromagnetic clutch CL4 is energized, and the copy paper transport means causes the sheet of copy paper brought as far as the transfer contact 59 to move through the transfer station 7, the transfer corona lamp TC of which is now actuated, and into contact with the toner particlecoated, image-carrying portion 1*a* of the belt 1, whereby the image of the document D is transferred onto the copy paper. When all of the sheet of copy paper has moved into the transfer station 7, the detection switch 59 returns to its unoperated state.

After this, the clutch CL4 remains engaged and the sheet of copy paper is transported through a fixing station, and then out of the apparatus, while the belt 1 continues to rotate, and the joint 1*b* thereof is carried to a point *f* whereupon the operation of the apparatus is terminated. Adjacent to point *f* there is an erasing unit 8 containing an eraser corona unit EC, and a cleaning unit 9 comprising a cleaning brush CB for removal of residual toner particles. The erasing unit 8 and cleaning unit 9 function during the whole time required to obtain one copy. If a plurality of copies is required, the abovedescribed operation is repeated, in immediate succession, a number times determined by a counting circuit associated with a coincidence circuit to which an operator supplies input corresponding to the number of copies required. Also, if copies at a different magnification are required, actuation of a relevant switch causes the timing of the abovedescribed operations relative to belt movement to be suitably adjusted.

Figure 2:
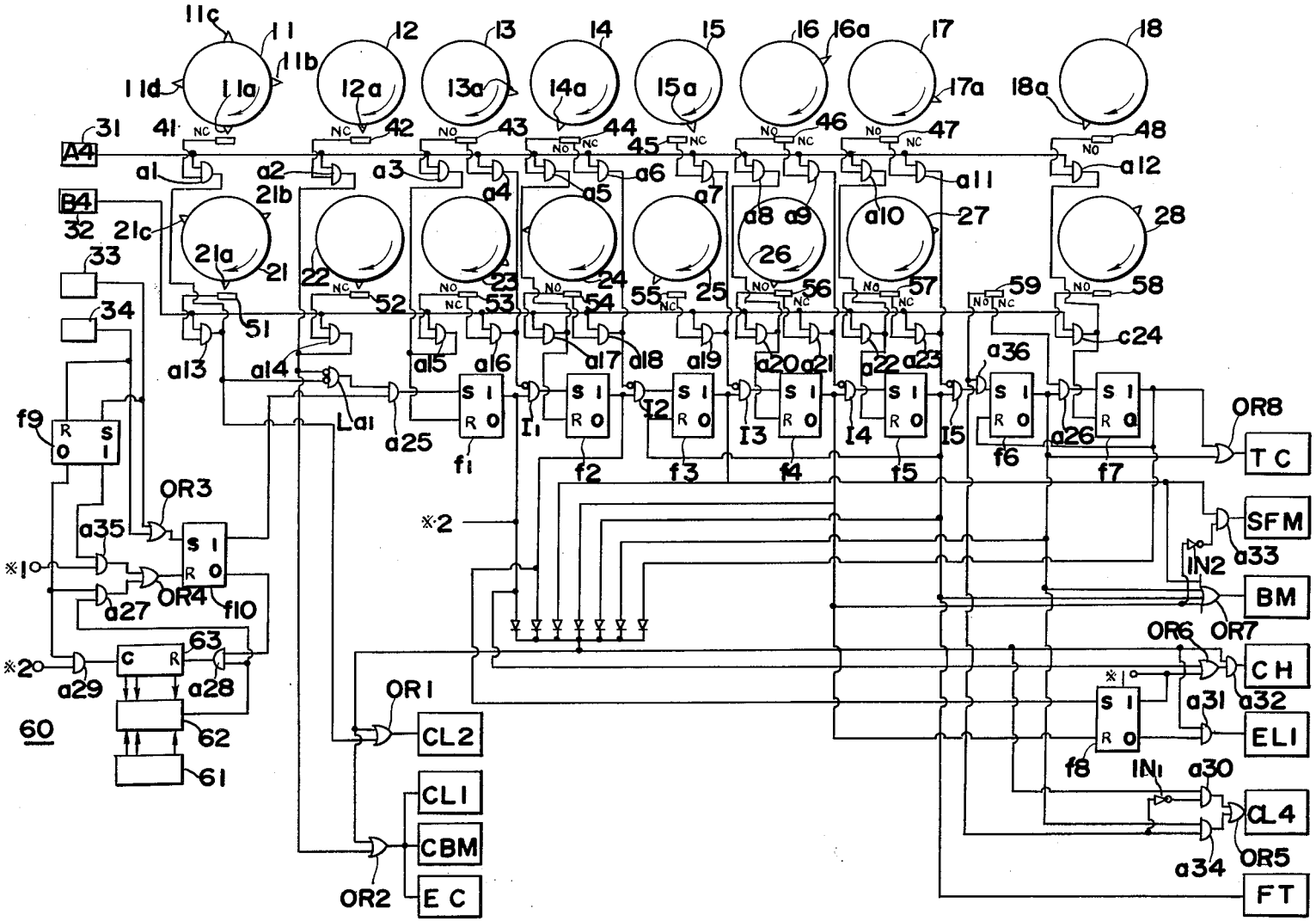
FIG. 2 is a block diagram of a control circuit of the apparatus of FIG. 1.

An exemplary means for effecting control of these various operations is shown in block diagram form in FIG. 2 to which reference is now had.

Describing first the general features and functions of the circuit shown, the abovementioned elements transfer corona unit TC, paper feed motor SFM, magnetic brush motor BM, corona charger lamp CH, inter-image eraser lamp EL1, paper transport means clutch CL4, and exposure flash lamp trigger circuit FT are actuated in accordance with input supplied thereto from flip-flops *f*1 through *f*8 and the abovementioned detection switch 59. Taking an equal sign to represent conditions for operation, a plus sign to represent provision of an OR gate, a multiply sign to represent provision of an AND gate and a bar to represent "zero" (i.e. reset) output for a flip-flop and non-operated state of the transfer contact 59, actuation of the various elements may be formularized as follows.

$$TC = f6 + f7$$

$$SFM = f3 \times \overline{f4}$$

$$BM = f3 + f4 + f5 + f6$$

$$CH = (f1 + f2 + \ldots + f7) \times (f1 + f8)$$

$$EL1 = (f1 + f2 + \ldots + f7) \times \overline{f8}$$

$$CL4 = (f1 + f2 + \ldots + f7) \times \overline{59} + f6 \times 59$$

$$FT = f5$$

The flip-flops *f*1 through *f*8 are actuated to provide "one" (set) or "zero" (reset) outputs in accordance with the actuation of switching contacts 41 through 48 by cams 11 through 18, which are effective when a switch 31 is actuated to select A4 size copies, or with the actuation of switching contacts 51 through 58 by cams 21 through 28, which are effective when a switch 32 is actuated to select B4 size copies. All the cams 11 through 18 and 21 through 28 are rotated synchronously by the belt 1. The cam 11 has four symmetrically disposed actuation pins for actuation of the switching contact 41, the cam 21 three symmetrically disposed actuation pins for actuation of the switching contact 21, and all the other cams 12 through 18 and 22 through 28 each have one actuation pin for actuation of their respective contacts 42 through 48 and 52 through 58. For each complete revolution of the belt 1 the cams 11 and 21 are rotated one complete revolution, the cams 12 through 18 associated with A4 size copies four complete revolutions, and the cams 22 through 28 associated with B4 size copies are rotated three complete revolutions. Thus for each complete revolution of the belt 1 the contacts 41 through 48 are each actuated four times, and the contacts 51 through 58 are each actuated three times. During belt rotation, the contacts 41 and 42 are operated simultaneously, after which the contacts 43 through 48 are actuated in succession to one another, in the order in which they are numbered. Similarly, the contacts 51 and 52 are actuated simultaneously, and the contacts 53 through 58 are then successively actuated in their numbered order.

The contacts 41 through 48 and 51 through 58 are all connected to a power supply not indicated, the contacts 41, 42, 45, 51, 52, and 55 being normally closed contacts, and therefore normally connected to the power supply, the contacts 48 and 58 being normally open contacts, and the contacts 43, 44, 46, 47, 53, 54, 56, and 57 being "break-before-make" tranfer contacts, i.e. in operation thereof there is a short moment during which both the normally open and the normally closed contacts thereof are open. Actuation of the switching contacts 41 through 48 by the cams 11 through 18 and actuation of switching contacts 51 through 58 by cams 21 through 28 result in exactly the same sequence of inputs to the flip-flops *f*1 through *f*8, but with different timing, in accordance with the copy magnification required.

Figure 6:
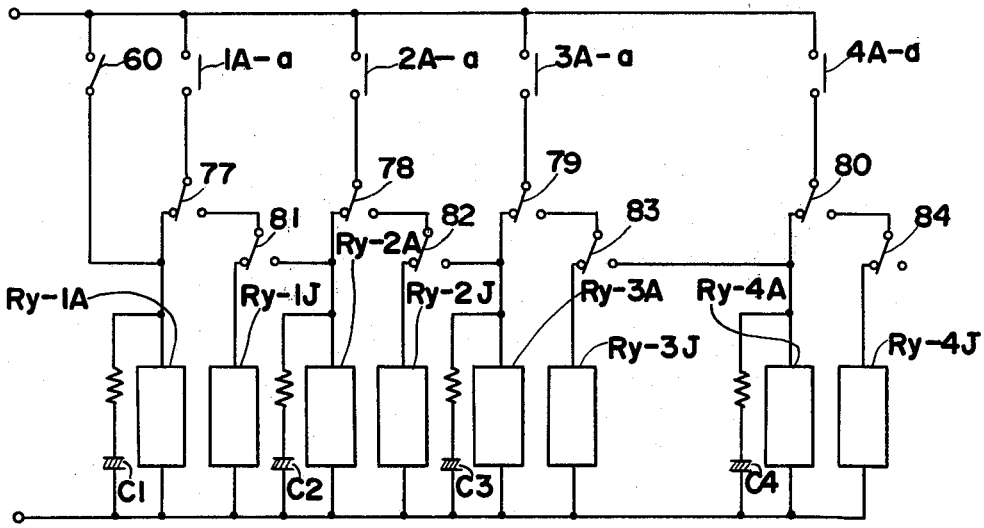
FIG. 6 is a circuit diagram of a modification of the copy paper jam detection and indication means employed in the apparatus of FIG. 4.

The abovementioned detection switch 59 is constituted by a transfer contact which connects to the power supply and has a normally open contact able to provide one input to an AND gate *a*26, which controls set input to flip-flop *f*7, and a normally open contact able to provide one input to an AND gate *a*36, which controls set input to flip-flop *f*6, to AND gate *a*34 and through an inverter IN1, to AND gate *a*30. Output from AND gates *a*30 and *a*34 is supplied through OR gate OR5 to actuate paper transport means clutch CL4. The detection switch 59, which as indicated in FIG. 6 is located adjacent to the entry of the transfer station 7, is to detect a paper-supply jam. If copy paper is supplied normally, the switch 59 normally open contact is closed, thus permitting flip-flop f6 to be set and the copying sequence to be continued, as will be described in greater detail below. If however paper supplied from the reserve 6 jams and fails to reach detection switch 59, flip-flop *f*6 cannot be set, and action of the apparatus stops, permitting an operator to know there is a jam. Needless to say, a jam may be further indicated by a lamp having an actuation circuit, not shown, connecting to the circuit of FIG. 2.

Another general feature of the circuit to be noted is that belt clutch CL2, cam clutch CL1, cleaning brush motor CBM, and eraser corona unit EC are always actuated when contacts 41 and 42 are unoperated, or whenever there is a "one" output from any of the flip-flops f1 through f7.

In greater detail, the action of the control means is as follows. The description will be given first in reference to the manner of control for obtaining a single copy or a plurality of copies of a document, and then in reference to actual action of the cams 11 through 18, or cams 21 through 28, and the circuit action for each copy produced.

Selection of one or a plurality of copies, either A4 size or B4 size, is effected by flip-flops *f*9 and *f*10, the condition of which is initially determined by actuation of a single copy switch 33 or a plural copy switch 34, and which are associated with a setting circuit 61, coincidence detection circuit 62, and counter 63. Single copy switch 33 provides a set input directly to flip-flop f9 and through an OR gate OR3 to flip-flop f10. Plural copy switch 34 supplies a reset input to flip-flop f9 and a set input, via OR gate OR3 to flip-flop f10. Flip-flop f10 "one" output is supplied as one input to AND gate *a*25 the output of which sets flip-flop *f*1. In other words, flip-flop *f*1 can be set and the sequence of circuit actions, described below, to obtain one copy can be effected only when flip-flop *f*10 is set. Flip-flop f10 reset input is supplied through OR gate OR4 from AND gate *a*35 or AND gate *a*27. One input to AND gate *a*35 is supplied by the "one" output of flip-flop f9. The other, final input to AND gate *a*35 is supplied by flip-flop *f*8, which is set by flip-flop *f*2 "one" output. Thus, when single copy switch 33 is closed, flip-flop *f*10 is initially set and allows flip-flop f1 to be set and control circuit action to commence, but as soon as flip-flop *f*2 is set, flip-flop *f*10 is reset, thus preventing subsequent setting of flip-flop *f*1 and repetition of circuit action more than once.

If however plural copy switch 34 is closed, flip-flop *f*9 is reset, whereby AND gate *a*35 is rendered inoperative and one input is supplied to AND gate *a*27, the other, final of which is supplied by coincidence circuit 62.

The number of copies required is set by the operator in setting circuit 61, which is a conventionally known circuit, and which supplies an initial reference input to the coincidence detection circuit 62. Comparison input to the coincidence circuit 62 is supplied from the counter 63. Coincidence detection circuit 62 and counter 63 may be known elements.

Input to the counter 63 is the output from AND data *a*29 which is enabled by inputs from the zero output of flip-flop *f*9 (reset by plural copy switch 34) and the one output of flip-flop *f*1. Thus the contents of counter 63 are increased by 1 upon each initiation of circuit action to obtain a copy. Each time the contents of counter 63 are thus increased, counter 63 supplies a comparison input corresponding to the new total to the coincidence detection circuit 63, which compares the input with the reference value supplied thereinto by setting circuit 61. If the reference and comparison inputs to coincidence circuit 62 do not match, there is no output from coincidence circuit 62. When, however, the reference and comparison inputs to coincidence detection circuit 62 match, i.e., when the current copying operation is that which will bring the number of copies obtained to the required total, coincidence detection circuit 62 produces an output which is supplied to one input terminal of AND gate *a*28, and as final input to AND gate 27, which thereupon supplies an output through OR gate OR4 to reset flip-flop *f*10. The zero output of flip-flop f10 enables AND gate *a*28, which supplies input to clear counter 63. Flip-flop f10 being reset, AND gate *a*25 is disabled, and after completion of the copy currently being produced, flip-flop *f*1 cannot be set to initiate another copying action.

Still referring to FIG. 2, and also referring to the timing chart of FIG. 3, action to obtain an A4 size copy of a document is as follows. Depression of switch 31 causes an input to be supplied to one input terminal of each AND gate a1 through *a*12. If at this time the joint 1*b* of the photosensitive belt 1 is not at the starting point X or at a point the distance from the starting point X of which is equal to a quarter-length of the belt 1, the normally closed contacts 41 and 42 are unoperated by the cams 11 and 12, and supply inputs to low level gate L*a*1, which therefore produces no output. At the same time, contact 41 output enables AND gate *a*1, the output of which is supplied through OR gate OR1 to energize belt clutch CL2, and contact 42 output enables AND gate *a*2, the output of which is supplied through OR gate OR2 to actuate cam clutch CL1, cleaning brush motor CBM, and eraser corona unit EC. The belt 1 and cams 11 through 18 and 21 through 28 are therefore all synchronously rotated until belt joint 1*b* reaches the starting point X, at which time the cams 11 and 12 open the contacts 41 and 42, respectively, whereby AND gates *a*1 and *a*2 are disabled. Low level gate L*a*1 therefore supplies input to AND gate *a*25, OR gates OR1 and OR2 are disabled and belt and cam rotation, and actuation of the cleaning brush motor CBM and eraser corona unit EC cease.

If now single copy switch 33 is actuated, "one" output from flip-flop f10 enables AND gate *a*25, which sets flip-flop f1. "One" output of flip-flop *f*1 enables OR gates OR1 and OR2, whereby belt clutch CL2, cam clutch CL1, cleaning brush motor CBM, and eraser corona unit EC are actuated. As noted earlier, these units are actuated throughout the entire copying operation, by "one" output from any of the flip-flops *f*1 through *f*7. Flip-flop *f*1 output is also supplied via a line L1 to AND gates *a*30 through *a*32. The line L1 is common to the "one" outputs of all the flip-flops f1 through *f*7, and there is therefore an input to at least one input terminal of each of the AND gates *a*30 through *a*32 during the entire copying operation. The other input to AND gate *a*30 is supplied by inverter IN1 connecting to the normally open contact of detection switch 59, which is unoperated at this time. AND gate *a*30 therefore produces an output to enable OR gate OR5, which actuates paper transport means clutch CL4. Hereupon, the paper transport means starts transporting a sheet of copy paper previously supplied thereto from the reserve 6 towards the location of the detection switch 59 in the vicinity of the transfer station 7 (FIG. 6). AND gate a31 is enabled by the "zero" output of flip-flop *f*8, which is reset at this time, and actuates the inter-image eraser lamp EL1. Flip-flop *f*1 output also enables OR gate OR6, which enables AND gate *a*32 to actuate charger corona CH.

Flip-flop *f*1 output is further supplied to one input of AND gate *a*29, which provides input to counter 63, but which is not enabled during single copy operation, since flip-flop *f*9 is set, as noted earlier.

As the belt and cams rotate, belt joint 1*b* is brought to point *a*, and cam 13 is brought to a position to actuate transfer contact 43. Opening of the normally closed contact of transfer contact 43 disables AND gate *a*4, thus removing inhibiting input to inhibitor I1 and permitting flip-flop *f*1 "one" output to be supplied therethrough to set flip-flop *f*2. Closure of the transfer contact 43 normally open contact enables AND gate *a*3 to reset flip-flop 1. Flip-flop *f*2 "one" output sets flip-flop *f*8, whereby AND gate *a*31 is disabled and the inter-image eraser lamp EL1 is turned off, while OR gate OR6 remains enabled and enables AND gate *a*32 to actuate corona charger CH. Flip-flop *f*8 output also enables AND gate *a*35 to enable OR gate OR4, which resets flip-flop *f*10. Paper transport means clutch CL4 remains engaged since conditions therefor are unchanged.

When the belt joint 1*b* reaches point *b*, cam 14 operates transfer contact 44. The normally closed contact of transfer contact 44 being opened, AND gate *a*6 is disabled, thus removing inhibiting input to inhibitor I2 and permitting flip-flop *f*2 output to set flip-flop *f*3. Closure of the normally open contact of transfer contact 44 enables AND gate *a*5 to reset flip-flop *f*2.

Conditions for corona charger CH and paper transport means clutch CL4 being unchanged, these elements continue to function. Flip-flop *f*3 "one" output enables OR gate OR7 to start actuation of toner brush motor BM, and is supplied to one input terminal of AND gate *a*33. The "one" output terminal of flip-flop *f*4 connects via an inverter IN2 to the other input terminal of AND gate *a*33. Flip-flop 4 being reset at this time, AND gate *a*33 is enabled and actuates paper supply motor SFM, which thereupon causes a sheet of copy paper to be supplied from the reserve 6 to as far as the paper transport means, in readiness for the next subsequent copy to be obtained.

While the belt joint 1*b* is travelling between the points *b* and *c*, the paper transport means brings the sheet of paper required for the current copy as far as the detection switch 59 which is therefore operated, thereby disabling AND gate *a*30 and disengaging clutch CL4 to temporarily halt action of the paper transport means.

When the belt joint 1*b* reaches point *c*, by which time all of a belt image portion 1*a* has been charged by the charger corona CH, cam 15 actuates normally closed contact 45. This action disables AND gate *a*7, the inhibiting input to inhibitor 13 of which is removed permitting flip-flop *f*3 "one" output to set flip-flop *f*4. At this stage, OR gate OR7 is still enabled and brush motor BM continues to function, but AND gate *a*33 is disabled and paper supply motor SFM action is terminated. Paper supply motor SFM remains unactuated until control circuit action is repeated to produce the next copy. Flip-flop *f*4 "one" output resets flip-flop *f*8, thereby disabling OR gate OR6 and AND gate *a*32 to terminate charger corona CH action, and simultaneously enabling AND gate *a*31 to actuate inter-image eraser lamp EL1, which remains actuated for the remainder of the copying operation, since flip-flop *f*8 is not subsequently set.

When the belt joint 1*b* reaches point *d* and the whole of the image portion 1*a* has been brought into the exposure area *a*4, cam 16 actuates transfer contact 46, thereby disabling AND gate *a*9 to remove inhibiting input to inhibitor I4 and permit flip-flop *f*4 "one" output to set flip-flop *f*5, and enabling AND gate *a*8 to reset flip-flop 4. Flip-flop *f*5 output resets flip-flop *f*3, enables OR gate OR7 to keep toner brush motor BM functioning, and also arms flash lamp trigger circuit FT, which actuates the flash lamps F (FIG. 6) to expose the belt image portion 1*a* to light reflected from a document D.

The belt joint 1*b* is then carried past developing station 5 actuated by toner brush motor BM, and brought to point *e*, at which time cam 17 actuates transfer contact 47, to enable AND gate *a*10 and disable AND gate *a*11. AND gate all being disabled there is no inhibiting input to inhibitor I5, which therefore passes flip-flop *f*5 output to one input terminal of AND gate *a*36, the other terminal of which receives input from detection switch 59 currently actuated by the presence of a sheet of copy paper adjacent to the entry of the transfer station 7. AND gate *a*36 therefore produces an output to set flip-flop *f*6, which enables OR gate OR8 to actuate transfer corona TC and OR gate OR7 to actuate toner brush motor BM, and also enables AND gate *a*34 to enable OR gate OR5, whereupon clutch CL4 is energized and the paper transport means carries the sheet of copy paper into contact with the belt image portion 1*a* and through the transfer station 7. AND gate *a*10 resets flip-flop *f*5, whereby flash-lamp trigger circuit FT is terminated and the flash-lamps F are turned off.

As belt 1 rotates and the sheet of copy paper is carried in contact therewith through the transfer station 7, the copy paper moves completely away from the detection switch 59, which therefore returns to its unoperated state. This disables AND gate *a*34, but simultaneously enables AND gate *a*30, whereby OR gate OR5 remains enabled to keep paper transport means clutch CL4 energized. Also, AND gate *a*26 is enabled to set flip-flop *f*7, which supplies reset input to flip-flop *f*6 and keeps AND gates *a*30 and *a*31 and OR gate OR8 enabled, thereby maintaining actuation of paper transport means clutch CL4, inter-image eraser lamp EL1, and transfer corona unit TC. However, flip-flop *f*6 being reset, OR gate OR6 is disabled, and toner brush motor BM stops.

The belt 1 continues to rotate while the paper transport means carries the sheet of copy paper, now having an image thereon, through the fixing station and then out of the apparatus. When the belt joint 1*b* reaches point *f*, cam 18 closes normally open contact 48, thereby enabling AND gate *a*12 to reset flip-flop *f*7. Three-quarters of one complete revolution of the belt 1 is required to bring the joint 1b from the starting point X to the point *f*. Therefore, simultaneously with closure of contact 48 by cam 18, the cams 11 and 12 open normally closed contacts 41 and 42, respectively, thereby enabling low level gate La1 to supply input to one input terminal of AND gate *a*25, the other input terminal of which, however, receives no input, since flip-flop *f*10 is now reset. There is therefore no setting input to flip-flop *f*1, and, all the flip-flops *f*1 through *f*7 being reset, apparatus operation ceases.

If a plurality of copies is required, and the plural copy switch 34 has been depressed, when the joint 1*b* reaches point *f*, flip-flop *f*10 is still set, and AND gate *a*15 is enabled to set flip-flop *f*1, whereupon the above described action of flip-flops *f*1 through *f*8 is repeated, and so on for a number of times determined by the contents of setting circuit 61, as described earlier.

The operation when switch 32 is depressed to obtain one or a plurality of B4 size copies is exactly analogous to the operation for obtaining A4 size copies, and is effected by cams 21 through 28 acting on contacts 51 through 58 to control operation of AND gates *a*13 through *a*24, the outputs of which effect the same functions as AND gates *a*1 through *a*12. The only difference in production of B4 size copies is that the circuit action sequence is repeated once each time the belt 1 travels one-third of a complete revolution, as opposed to once each time the belt 1 travels one-fourth of a complete revolution as in the production of A4 size copies.

Figure 4:
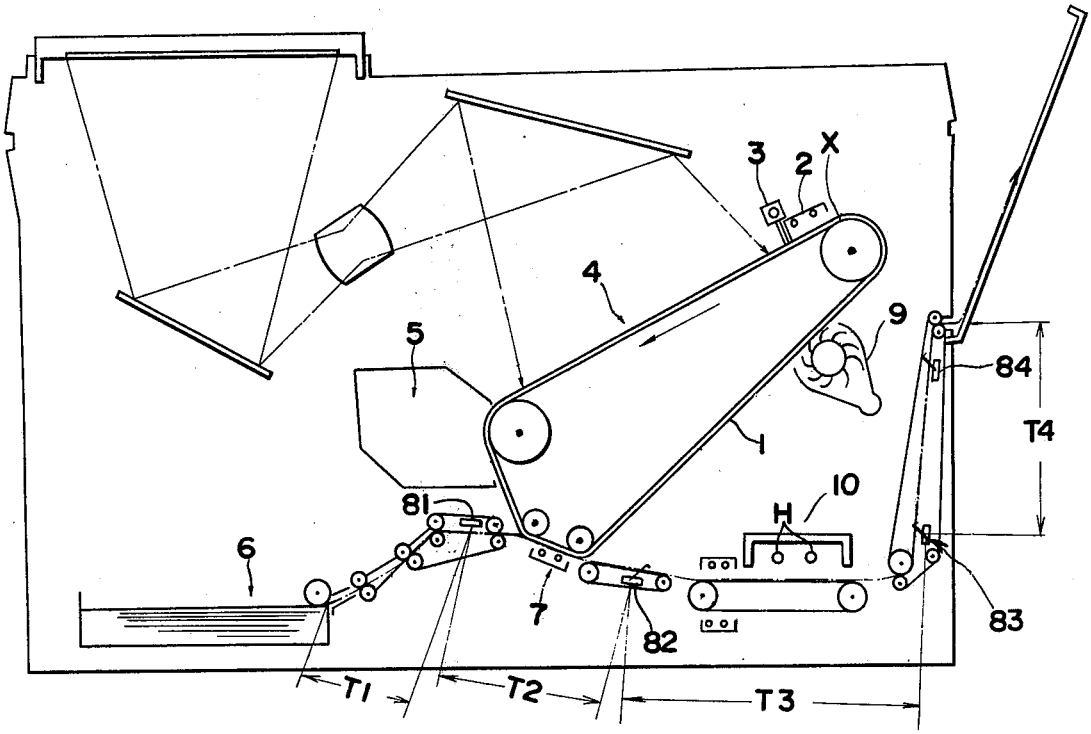
FIG. 4 is a schematic layout view of an electrophotographic apparatus according to a second embodiment of the invention showing the location of copy paper jam detection switches.

Reference is now had to FIG. 4 showing a second embodiment of the invention, which has the same general layout as the first embodiment shown in FIG. 1, but instead of a single detection switch 59 actuable by passage of a sheet of copy paper it has four detection switches 81, 82, 83 and 84 which are located respectively adjacent to the entrance of transfer station 7, intermediate the transfer station 7 and the fixing station 10, slightly beyond the exit of the fixing station 10, and adjacent to the copy paper exit from the apparatus. For the purposes of description, reference will be made below to four stages, T1 through T4, of copy paper transport, T1 being the transport stage from the copy paper reserve 6 to the location of the detection switch 81, T2 the transport stage between detection switches 81 and 82, T3 the transport stage between detection switches 82 and 83, and T4 the transport stage between detection switches 73 and 74.

Figure 5:
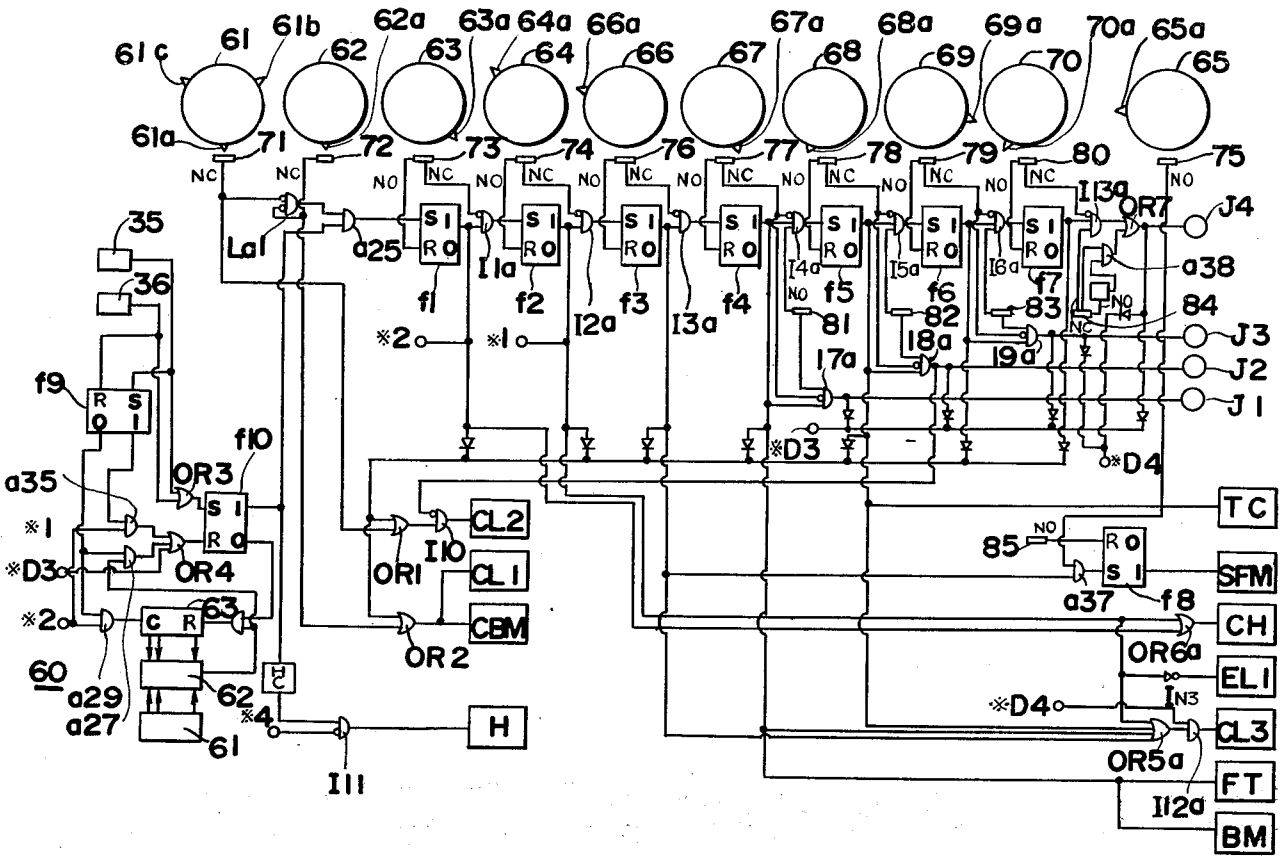
FIG. 5 is a block diagram of a control circuit employed in the apparatus of FIG. 4.

The apparatus according to the second embodiment is suitably employed in the production of one or a plurality of documents at a single magnification, and comprises a simplified control circuit such as shown in FIG. 5, to which reference is now had. As in the control circuit of the first embodiment, the circuit comprises flip-flops *f*1 through *f*8, the outputs of which determine action of the various work stations of the apparatus, and which are successively set and reset in accordance with actuation of switches 71 through 80 by cams 61 through 70 synchronously rotatable with the photosensitive belt 1. Action of flip-flops *f*4 through *f*7 is also combinable with action of detection switches 81 through 84 in a manner described in further detail below to produce signals supplied to detection terminals D3 and D4 and to actuate jam indicator lamps J1 through J4. Apparatus elements actuated include transfer corona unit TC, paper supply motor SFM, charger corona CH, inter-image eraser lamp EL1, flash lamp trigger circuit FT, toner brush motor BM, and paper transport means clutch CL3. In this embodiment, the paper transport means for carrying copy paper over stages T2 through T4 (FIG. 4) is actuated throughout the entire copying operation by engagement of a clutch not indicated, and clutch CL3 serves to couple the drive to paper transport means for carrying copy paper over transport stage T1, i.e., from reserve 6 to detection switch 81. Circuitry for single or plural copy selection is as in the first embodiment except that OR gate OR4 may be enabled to reset flip-flop *f*10 by a further input from detection terminal D3, and flip-flop *f*2 is supplied directly to AND gate *a*29, instead of acting through flip-flop *f*8, which in this embodiment is set by combined input from flip-flop *f*3 and normally open contact 75, and serves to actuate paper supply motor SFM. When set, flip-flop *f*10 starts actuation of a heater control circuit HC, which includes a timer T2 for maintenance of circuit action for the duration of one copying action, even subsequent to resetting of flip-flop *f*10, and the output of which is supplied through inhibitor I11 to heater H in fixing station 10. Input to heater H may be stopped by inhibiting input supplied to inhibitor I11 from detection terminal D4. Input from normally closed contacts 71 and 72 or from any of the flip-flops *f*1 through *f*7 enables OR gates OR1 and OR2. OR gate OR2 actuates cleaning brush motor CBM. OR gate OR1 output is gated through inhibitor I10 to actuate cam clutch CL1 and belt clutch CL2, and may be stopped by inhibiting input supplied to inhibitor I10 from inhibitor I8 associated with detection switch 82.

In this embodiment since copies of only one magnification are obtained copy-size selection switches are unnecessary, and to provide inputs to flip-flops *f*1 through *f*7 the gating system of AND gates *a*1 through *a*12 and *a*13 through *a*24 may be dispensed with. The cams 61 and 62, which have the same function as cams 21 and 22 described in connection with the first embodiment, act on normally closed contacts 71 and 72, respectively to bring the belt joint 1*b* to the starting point X or permit setting of flip-flop *f*1 to initiate control circuit action. The contact 75 is a normally open contact via which input may be supplied to one input of AND gate *a*37, the other input of which is provided as the "one" output of flip-flop *f*3, and which provides set input to flip-flop *f*8. The contacts 73, 74 and 76 through 79 are all break-before-make transfer contacts which are actuated in succession to one another by cams 63, 64 and 66 through 69. Contacts 73 and 74 have normally open terminals connecting to the reset input terminals of flip-flops *f*1 and *f*2, and contacts 76 through 80 have normally open terminals connecting to the reset input terminals of flip-flops *f*3 through *f*7, respectively. The normally closed terminals of transfer contacts 63, 64, 66 through 80 provide inhibiting input to inhibitors I1*a* through I6*a*, via which "one" output from flip-flops *f*1 through *f*6 may be supplied to set flip-flops *f*2 through *f*7. For setting input to be passed through inhibitors I1*a* through I3*a* the only condition is that operation of transfer contacts 73, 74 and 76 coincide with "one" from flip-flops *f*1 through *f*3 respectively. The condition for setting input to be passed through inhibitors I4*a* through I6*a* respectively is that there be coincidence of actuation of transfer contacts 77 through 79, "one" output from flip-flops *f*4 through *f*6, and actuation of copy paper detection switches 81 through 83.

The detection switches 81 through 83 are constituted by transfer contacts which are actuable by a sheet copy paper coming to the location thereof. The detection switch 81 has a normally open terminal connecting to the input side of inhibitor I4*a* and a normally closed terminal providing input to inhibitor I7*a*, which may receive another input provided by the "one" output of flip-flops *f*4, and inhibiting input from the normally closed terminal of transfer contact 76. Detection switches 82 and 83, transfer contacts 77 and 78, flip-flops *f*5 and *f*6, and inhibitors I5*a*, I6*a*, I8*a* and I9*a* are similarly connected. The outputs of inhibitors I7*a*, I8*a*, and I9*a* provide activating input to warning lamps J1, J2 and J3, respectively, which are provided on the exterior of the electrophotographic apparatus, and also are all connected to the abovementioned detection terminal D3. Inhibitor I9*a* output further connects to the abovementioned detection terminal D4.

The copy paper detection switch 84 is constituted by a transfer contact actuable by a sheet of copy paper, and having a normally closed terminal connecting to inhibitor I13, which receives another input from the "one" output of flip-flop *f*7, and an inhibiting input from the normally closed terminal of transfer contact 79, and enables OR gate OR7 to actuate warning lamp J4 and provide input to detection terminals D3 and D4. The normally open terminal of detection switch 84 connects both directly, and through timer T1 to AND gate a38 which enables OR gate OR7. Timer T1 action is initiated upon closure of the normally open terminal of detection switch 84, and after a time sufficient for a sheet of copy paper to have completely passed the location of detection switch 84, timer T1 supplies input to one input terminal of AND gate *a*38.

Supposing there is no copy paper jam the above-described control means functions as follows. Upon depression of a start switch not indicated and of either single copy switch 35 or plural copy switch 36, flip-flop *f*1 is set by AND gate a25, immediately, or after belt joint 1b has been brought to starting point X or to a distance equal to one-third of total belt length therefrom. The belt clutch CL2, cam clutch CL1, and cleaning brush motor CBM are now actuated, and remain actuated throughout the copying operation by input from any one of the flip-flops *f*1 through *f*7. Flip-flops *f*1 and *f*2 output serve in the functioning of the copy number control section 60 in the same manner as described earlier. When cam 63 actuates transfer contact 73 flip-flop *f*1 is reset, and flip-flop *f*2 is turned on and enables OR gate OR6*a* to actuate charger corona unit CH, and OR gate OR5a to enable inhibitor I12, which actuates paper transport means clutch CL3. A sheet of copy paper C1 supplied from the reserve 6 during the previous copying operation now begins to be carried over transport stage T1 to transfer station 7 and the location of detection switch 81. OR gate OR5*a* and inhibitor I12 subsequently remain enabled by input from flip-flops *f*3, *f*4, and *f*5, and then receive no further input.

Upon actuation of transfer contact 74 by cam 64, flip-flop *f*3 is set, and flip-flop *f*2 is reset. Flip-flop *f*2 being reset inverter IN3 is enabled to actuate inter-image erasure unit EL1, which remains actuated until termination of apparatus operation to obtain one copy. By this time the whole of an image portion 1*a* of the belt 1 has been charged by the charger corona unit CH, which is now turned off since OR gate OR6*a* is disabled, while clutch CL3 remains engaged. While flip-flop *f*3 remains set cam 65 closes normally open contact 75, thereby enabling AND gate a37 to set flip-flop *f*8. Flip-flop *f*8 produces a "one" output to actuate paper supply motor SFM, and cause a sheet of copy paper C2 to start being brought from the reserve 6 to transport stage T1, in readiness for the next subsequent copy.

Next, cam 66 actuates transfer contact 76, thereby resetting flip-flop f3 and setting flip-flop f4. By this time, the whole of belt image portion 1*a* lies in exposure area 4, and flip-flop *f*4 "one" output actuates flash trigger circuit FT, and starts toner brush motor BM. Subsequent to resetting of flip-flop *f*3 the sheet of copy paper C2 reaches and closes normally open contact 85, which is located at the entry of transport stage T1, thereby resetting flip-flop *f*8 and terminating action of paper supply motor SFM. AND gate *a*37 now being disabled, flip-flop *f*8 cannot be set again.

While flip-flop *f*4 is still set, the sheet of copy paper C1 reaches and actuates detection switch 81, which thereupon removes one input from inhibitor 17*a* and supplies one input to inhibitor I4*a*. The sheet of copy paper C1 maintains actuation of detection switch 81 while being moved from transport stage T1 to transport stage T2, through the transfer unit 7 and into contact with the toner-coated image portion 1*a* of the belt 1.

As the belt image portion 1*a* and sheet of copy paper C1 enter transfer station 7, cam 67 actuates transfer contact 77, thereby enabling inhibitor I4*a* to set flip-flop *f*5, and resetting flip-flop *f*4. Flip-flop *f*5 "one" output energizes transfer corona TC. Toner brush motor BM is now turned off, coating of belt image portion 1*a* being complete.

As the sheet of copy paper C1 is carried through transport stage T2 the rear end thereof moves away from the location of detection switch 81, which therefore returns to its normal state, and the leading end thereof reaches and actuates detection switch 82 between transfer station 7 and fixing station 10, thereby cancelling one input to inhibitor I8*a* and supplying input to one input terminal of inhibitor I5*a*.

In this state, actuation of transfer contact 78 by cam 68 enables inhibitor I5*a* to set flip-flop *f*6, and resets flip-flop *f*5, thereby de-energizing transfer corona TC and disabling OR gate OR 5*a* and inhibitor I12*a* to disengage clutch CL3 and terminate paper transport means operation in transport stage T1. Transport means action in transport stages T2 through T4, however, continues throughout entire copying operation as noted earlier, and so, as belt 1 continues to rotate, the sheet of copy paper C1 is carried from transport stage T2 to transport stage T3, through fixing station 10, the heater H of which is maintained in actuation by the timer T2 in the heater control circuit HC initially actuated by flip-flop *f*10 "one" output, and then to transport stage T4, to a position to actuate detection switch 83.

While detection switch 83 remains actuated cam 69 actuates transfer contact 79, which enables inhibitor I6*a* to set flip-flop *f*7, and resets flip-flop *f*6. In this condition, the sheet of copy paper C1 reaches and actuates detection switch 84 adjacent to the copy paper exit from the apparatus, thereby cancelling one input to inhibitor I13*a*. Therefore, when, cam 70 actuates transfer contact 80, inhibitor I13*a*, and hence OR gate OR7, cannot be enabled, and flip-flop *f*7 is reset, thereby de-energizing belt clutch CL2, cam clutch CL1, and cleaning brush motor CBM. At this time also heater control circuit HC de-energizes heater H. Closure of the normally open terminal of detection switch 84 supplies one input to AND gate *a*38 and initiates action of timer T1. However, if the sheet of copy paper C1 is transported past the location of detection switch 84 in a normal manner, the normally open terminal of switch 84 opens again before timer T1 produces an output, whereby AND gate *a*38 is not enabled.

Copy paper jam detection and warning action is as follows. From transport stage T1 to transport stage T2, if the sheet of copy paper fails to reach and actuate detection switch 81, when cam 67 actuates transfer contact 77, inhibitor I4a cannot be enabled to set flip-flop *f*5, since the normally open terminal of detection switch 81 is still open, while at the same time inhibiting input supplied to inhibitor 17*a* from the normally closed terminal of transfer contact 77 is removed, thus permitting input from flip-flop *f*4 and the normally closed terminal of detection switch 81 to enable inhibitor 17*a*, which activates lamp J1, and acting through detection terminal D3, supplies an inhibiting input to inhibitor I12*a*, thereby disengaging clutch CL3, and enables OR4 to reset flip-flop *f*10, this last action being effective, of course, only during operation to obtain a plurality of copies. Also, flip-flop *f*4 being reset, all flip-flops *f*1 through *f*8 are now off, thus resulting in stopping of cleaning brush motor CBM, and disengagement of cam clutch CL1 and belt clutch CL2.

Failure of the sheet of copy paper C1 to reach detection switches 82 and 83 prior to actuation of contacts 78 and 79 by cams 68 and 69, respectively, results in similar action, the lamps lit being lamps J2 and J3. Inhibitor I8*a* output also disables inhibitor I10*a*, which normally actuates belt clutch CL2. Since failure of detection switch 83 to be actuated at the requisite time would mean that a sheet of copy paper is jammed in the fixing station 10, to preclude the possibility of ignition of such a sheet of copy paper, output of the inhibitor I9*a*, enabled due to non-actuation of detection 83, is supplied through detection terminal D4 as inhibiting input to inhibitor I11*a*, thereby de-energizing heater H.

If detection switch 84 fails to be actuated, when cam 70 actuates transfer contact 80, inhibitor I13*a* is enabled to enable OR gate OR7, which actuates warning lamp J4, supplies a signal through detection terminal D3 to reset flip-flop *f*10, and a signal through detection terminal D4 to disable inhibitor I11*a*, thus de-energizing heater H.

Referring now to FIG. 6 there is shown a modification of the copy paper jam detection and warning circuit of the control circuit of FIG. 5. In this modified circuit there are provided relays R*y*-1A through R*y*-4A in parallel with capacitors C1 through C4 and connected across two lines leading from a power supply, not indicated, through the normally closed terminals of transfer contacts 77 through 80 and normally open contacts 1A-*a* through 4A-*a* in series with transfer contacts 77 through 80 and actuable by relays R*y*-1A through R*y*-4A. The power circuit to relay R*y*-1A may also be closed by a normally open start switch A in parallel with normally open contact 1A-*a* and transfer contact 77. The relays R*y*-2A through R*y*-4*a* connect are further connectable to the power lines through normally open contacts 1A-*a* through 3A-*a* and the normally open terminals of transfer contacts 77 through 79 and of detection switches 81 through 83. There are also provided relays R*y*-1J through R*y*-4J, which may actuate the indicator lamps J1 through J4 and which are connectable to the power lines through the normally open contacts 1A-*a* through 4A-*a*, the normally open terminals of transfer contacts 77 through 80, and the normally closed terminals of detection switches 81 through 84.

The circuit functions as follows. After start of apparatus operation to obtain a copy of a document, when belt 1 reaches a particular point for example point *e*, start switch A is closed, by belt 1 itself, for example. Hereupon, relay R*y*-1A is energized, and, acting through the normally closed terminal of transfer contact 77 closes contact 1A-*a*, while at the same time capacitor C1 is charged to a particular value. Seen from capacitor C1 relay R*y*-1A is a resistor, and subsequent to re-opening of start switch A, as belt 1 continues to rotate, capacitor C1 discharges through, and maintains energization of relay R*y*-1A, for a time dependent on the value of capacitor C1 and the resistance offered by R*y*-1A. If the copy paper advances correctly, detection switch 81 is actuated thereby, and when transfer contact 77 is actuated by cam 67 the power circuit to relay R*y*-2A and capacitor C2 is closed, through contact 1A-*a*, and the normally open terminals of transfer contact 77 and detection switch 81. If the copy paper does not reach detection switch 81 prior to actuation of transfer contact 77 by cam 67, relay R*y*-2A fails to be energized, and instead the power circuit to relay R*y*-1J is closed through contact 1A-*a*, the normally open terminal of transfer contact 77 and the normally closed terminal of detection switch 81, whereby indicator lamp J1 is lit. Lighting of the other lamps J2 through J4 may be effected in an analogous manner.

As is clear from the above description the present invention provides an electrophotographic apparatus wherein the work station is always kept in step with the photosensitive belt movement by a unitary circuit, and wherein a copy paper jam results in suspension of apparatus operation, stopping of apparatus elements liable to constitute a danger, and visual indication of the paper jam location.

What is claimed is:

1. In an electrophotographic means comprising main drive means, a belt which carries an electrophotosensitive medium adapted to form an electrostatic image in response to image light directed thereonto, and is movable past a plurality of work stations including a charging station, belt drive means driving said belt, an inter-image portion erasure station, a developing station, a charge erasure station, and a cleaning station, and also comprising an image receiving material transport means able to carry successive portions of image receiving material to said transfer station, into image receiving contact with said belt, through image fixing means and out of said electrophotographic means, and an image receiving supply work station actuable to supply image receiving material from a reserve to said image receiving material transport means, an electrophotographic apparatus comprising:

a plurality of work station actuation means coupled to the respective work stations for actuating them;

an image receiving material transport means actuation means coupled to said image receiving material transport means for actuating it;

a unitary control circuit which includes:

a bank of memory elements the states of the individual elements of which are determined by combinations of external signals supplied thereto and signals from the other members of said bank, and combinations of the outputs of which are coupled to the respective work station actuating means and the image receiving material transport means actuation means for determining the operation of said work station actuating means and said image receiving material transport means actuation means, and a copy number control means coupled to said bank and external signals supplied thereto and to signals from said bank and productive of output upon repetition of circuit action of said bank a number of times corresponding to the number of copies required;

first rotary switching means which is rotatable synchronously with said belt and coupled to said bank for producing external signals to be supplied in a requisite succession to said bank, at a frequency selected in reference to the speed of movement of said belt to effect production of a copy having a particular lengths;

belt drive engagement means coupled to said belt drive means and rotary switching means engagement means coupled to said first rotary switching means and both said lastmentioned means being coupled to said bank and being actuable by external signals supplied thereto and signals from said bank; and at least one supplementary rotary switching means rotatable synchronously with said belt and selectively connectable to said bank by an externally supplied signal for effecting supply of external signals to said bank in a requisite succession and at a frequency differing from the frequency of signals generated by said first rotary switching means, whereby copies having different lengths may be produced.

2. In a high speed electrophotographic copying apparatus adapted to produce a plurality of copies of the same original in succession, and which includes a device for detecting jamming of copy paper, said detecting device comprising;

means for feeding lengths of copy paper in succession along a copy paper path through which the copy paper passes for obtaining a plurality of copies of the same original, said feeding means feeding the lengths of copy paper one by one in timed relation so that a plurality of lengths of copy paper are present in the copy paper paths simultaneously in spaced relation, a plurality of copy paper detecting means provided at positions spaced along said copy paper path and responsive to arrival of a copy paper at the respective positions, a plurality of timer means, one associated with each of said detecting means, a plurality of jam determining means associated with said respective detecting means and timer means for detecting jamming of copy paper when a copy paper fails to reach one of said corresponding detecting means within a time defined by said corresponding timer means, each of said determining means being coupled at least to said feeding means for stopping operation of said feeding means when jamming of the copy paper is detected so that further feeding of the lengths of copy paper succeeding the jammed copy paper is prevented while the feeding of copy papers preceeding the jammed copy paper is continued.

3. An electrophotographic copying apparatus as set forth in claim 2 further including a plurality of warning means associated with each of said determining means for warning of the existence of jammed copy paper and identifying the location of jammed copy paper.

4. In a high speed electrophotographic copying apparatus adapted to produce a plurality of copies of the same original in succession and which includes a device for detecting jamming of copy paper, comprising;

means for feeding lengths of copy paper one by one in succession along a copy paper path in timed relatiion so that a plurality of lengths of copy paper are present on the copy paper path simultaneously in spaced relation, a plurality of copy paper detecting means provided at positions spaced along said copy paper path and responsive to arrival of a copy paper for generating a first signal, a plurality of timer means, one associated with each of said detecting means for generating a second signal indicative of time by which the copy paper should arrive at a corresponding detecting means, a plurality of jam determining means associated with respective detecting means and timer means for detecting generation of said first signal prior to generation of said second signal, a plurality of shifting means associated with the respective jam determining means and said feeding means for shifting to the next jam determining means when no jamming occurs and for stopping operation of said feeding means if the copy paper fails to arrive at one of said detecting means within a time defined by said corresponding timer means.

5. In an image transfer type electrophotographic copying apparatus which includes a rotatably driven photosensitive member, charging means for applying charge onto said photosensitive member, image exposing means for forming an electrostatic latent image thereon and an image transfer means for transferring an image onto a copy paper, feeding means for feeding lengths of copy paper in succession along a copy paper path, said image transfer means being on said copy paper path, and a fixing means on said copy paper path for fixing a transferred image on the copy paper, an improved device for detecting jamming of copy paper on said copy paper path which comprises:

a plurality of copy paper detecting means positioned along said copy paper path at spaced intervals and responsive to arrival of copy paper at the respective means, the first of said detecting means being coupled to said feeding means for stopping operation of said feeding means, the second of said detection means being coupled to said feeding means and said photosensitive member for stopping operation of said feeding means and said rotation of the photosensitive member, the third of said detection means being coupled to said feeding means, said photosensitive member and said fixing means for stopping operation of said feeding means, rotation of said photosensitive member and operation of said fixing means, a plurality of timer means, one associated with each of said detection means for indicating a time by which the copy paper should arrive at the corresponding detection means, a plurality of jam determining means, one associated with each of said detection means and said timer means for determining arrival of a copy paper at the associated detection means within a time defined by the associated timer means, a plurality of shifting means, one associated with each of said jam determining means for shifting to the next one of said jam determining means when no jamming is detected by the previous detection means, and for being inhibited from shifting upon determination of jamming by said jam determining means, and for causing said detection means to stop the operations of the means associated therewith, said feeding means including means for feeding lengths of copy paper in succession for obtaining plural copies of an image so that a plurality of lengths of copy paper are present on the copy paper path simultaneously, a plurality of warning means associated with each of said shifting means for indicating the location of jamming a copy paper when jamming is detected and said shifting means is inhibited from shifting.

* * * * *